US006635332B1

(12) United States Patent
McArthur

(10) Patent No.: US 6,635,332 B1
(45) **Date of Patent: *Oct. 21, 2003**

(54) SANITARY HOLDER

(76) Inventor: Erich McArthur, 688 Chicken Lyle Rd., Winder, GA (US) 30680

( * ) Notice: Subject to any disclaimer, the term of this patent is extended or adjusted under 35 U.S.C. 154(b) by 0 days.

This patent is subject to a terminal disclaimer.

(21) Appl. No.: 09/915,925

(22) Filed: Jul. 26, 2001

Related U.S. Application Data

(63) Continuation-in-part of application No. 09/287,648, filed on Apr. 7, 1999, now Pat. No. 6,268,040.

(51) Int. Cl.[7] ..... B32B 3/24

(52) U.S. Cl. ..... 428/132; 428/131; 428/192; 428/119; 428/156; 428/174; 220/782; 220/709; 220/736; 220/713; 206/352; 206/362; 206/362.1; 211/70.7; 211/65; D6/528; D6/534; D6/526; 248/37.3; 248/37.6; 248/110

(58) Field of Search ..... 428/131, 132, 428/192, 119, 156, 174; 220/782, 709, 736, 713; 206/352, 362, 362.1; 211/70.7, 65; D6/528, 534, 526; 248/37.3, 37.6, 110

(56) References Cited

U.S. PATENT DOCUMENTS

| | | | | | |
|---|---|---|---|---|---|
| 1,972,532 | A | * | 9/1934 | McMillan | D6/534 |
| D228,271 | S | * | 9/1973 | Tegner | D6/92 |
| 4,566,597 | A | * | 1/1986 | Caputo et al. | 211/87 |
| D294,093 | S | * | 2/1988 | Tegner | D6/531 |
| 6,027,081 | A | * | 2/2000 | Rosenberg | 248/37.6 |

* cited by examiner

*Primary Examiner*—William P. Watkins, III
(74) *Attorney, Agent, or Firm*—Rodgers & Rodgers

(57) ABSTRACT

A sanitary holder comprising a base panel, at least one aperture formed in the base panel, a sanitary band joined to the base panel and extending around the periphery of the aperture, and another sanitary band joined to the base panel and extending around the periphery thereof.

8 Claims, 3 Drawing Sheets

SANITARY HOLDER

This is a continuation-in-part of application Ser. No. 09/287,648 filed Apr. 7, 1999, now U.S. Pat. No. 6,268,040.

BACKGROUND OF THE INVENTION

In hotels, hospitals and other similar types of facilities intended for overnight or extended stays, local laws and ordinances typically prohibit permanent fixtures intended for storage of personal care items. For example, conventional bathroom wall mounted combination toothbrush and tumbler or glass holders a are not allowed in public accommodation facilities because of the unsanitary nature of these holders due to bacterial buildup. As a result, a patron of a hotel, motel or other like establishment must place his or her personal care items on the sink top, in a drawer and the like wherein such items are disorganized and are more likely to become contaminated or misplaced.

BRIEF SUMMARY OF THE INVENTION

A sanitary holder for use in connection with toothbrushes and/or razors comprising a base panel, at least one aperture formed in the base panel, a band integrally joined to the outer edge of the base panel and extending around the periphery thereof.

DETAILED DESCRIPTION OF THE INVENTION

Figure 1:
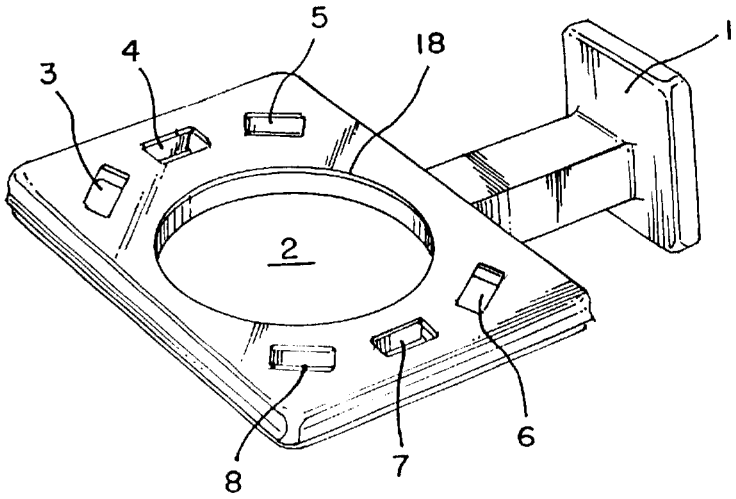
FIG. 1 is a perspective view of a wall mounted toothbrush and tumbler receptacle.

In the drawings and with particular reference to FIG. 1, the numeral 1 designates a conventional wall mounted toothbrush and tumbler receptacle. More specifically, receptacle 1 includes an aperture 2 for receiving a tumbler or glass and also includes multiple generally rectangular apertures 3–8.

Figure 2:
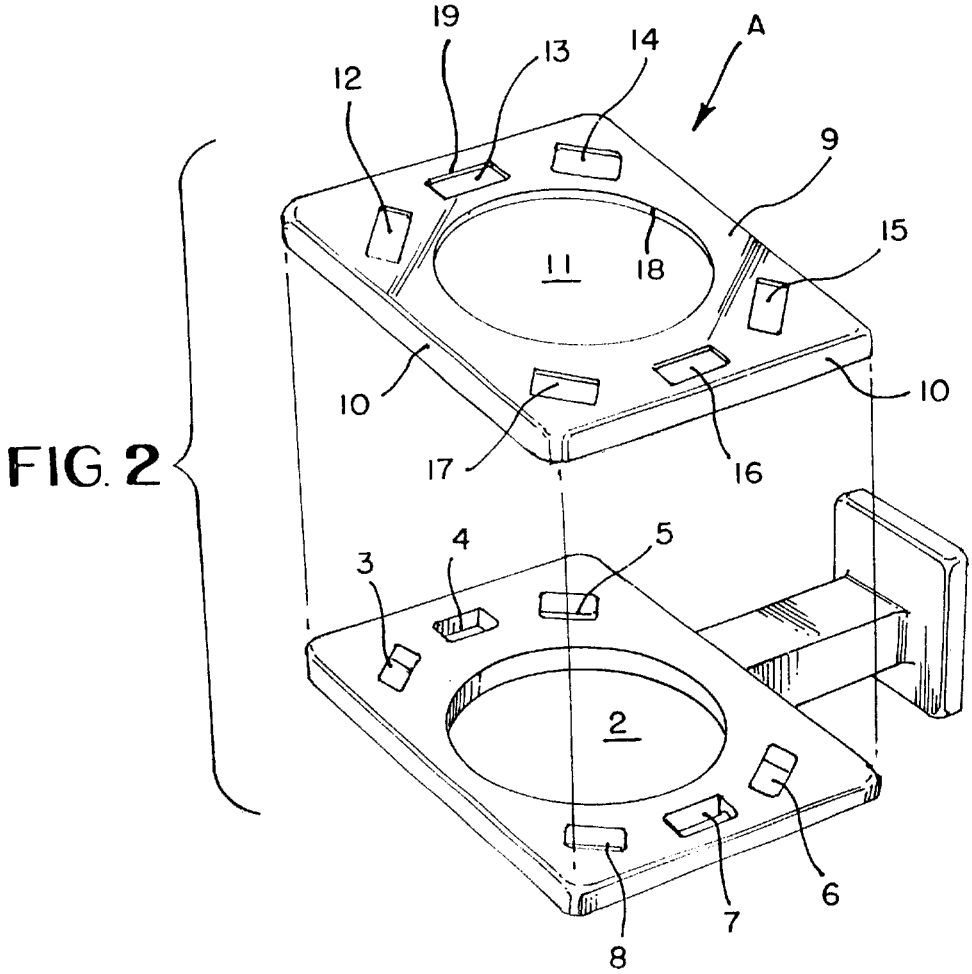
FIG. 2 is an exploded view of the receptacle shown in FIG. 1 and associated holder according to this invention.

According to one form of this invention and as best shown in FIG. 2, a sanitary holder is provided and is generally indicated by the letter A. More specifically, holder A includes base panel 9 with side panels 10 integrally joined to each outer edge of base panel 9 and extending downwardly therefrom to form a continuous sanitary band around holder A. In addition, center aperture 11 and multiple generally rectangular apertures 12–17 are formed in base panel 9. Aperture 11 includes wall 18 which is integrally joined to base panel 9 around the periphery of aperture 11 and extends downwardly therefrom. Of course, aperture 11 can be omitted, if desired.

Each of the apertures 12–17 is of identical construction and includes multiple side walls 19 integrally joined respectfully to base panel 9 at the peripheral edges of apertures 12–17 and extending downwardly therefrom. Each end of side walls 19 is integrally joined to the adjacent end of each associated side wall 19 to form a continuous sanitary band which overlaps the associated edges and extends into respective apertures 3–8 of holder A.

Figure 3:
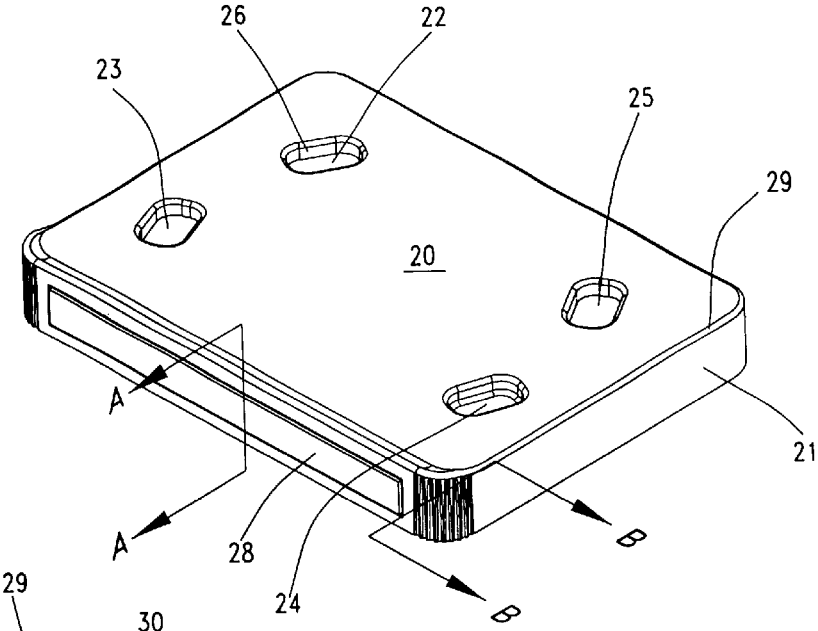
FIG. 3 is a perspective view of a modified form of this invention.
Figure 4:
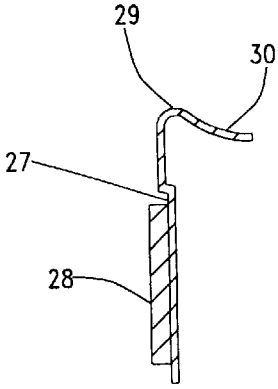
FIG. 4 is a cross-sectional view taken along the line A—A in FIG. 3.
Figure 5:
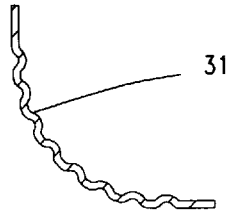
FIG. 5 is an cross-sectional view taken along the line B—B in FIG. 3.

A modified form of the invention is shown in FIG. 3 wherein a disposable sanitary holder for toothbrushes is depicted and wherein the numeral 20 designates the holder base panel with sanitary band 21 integrally joined to the peripheral edge of base panel 20. In addition, multiple apertures 22–25 are provided and are of identical construction and each includes a sanitary band 26 integrally joined to base panel 20 and extending around the entire edge of each aperture. Further, indentation 27 is formed in sanitary band 21, as best shown in FIG. 4, and includes two-sided adhesive tape 28 disposed in indentation 27 and adhered to sanitary band 21. For the purpose of increasing rigidity to the holder, the entire peripheral edge of base panel 20 is raised by means of the combination of ridge 29 and slope 30. As shown in FIG. 5, ripples 31 are formed at each corner of sanitary band 21 for the purpose of providing additional strength to the holder.

Figure 6:
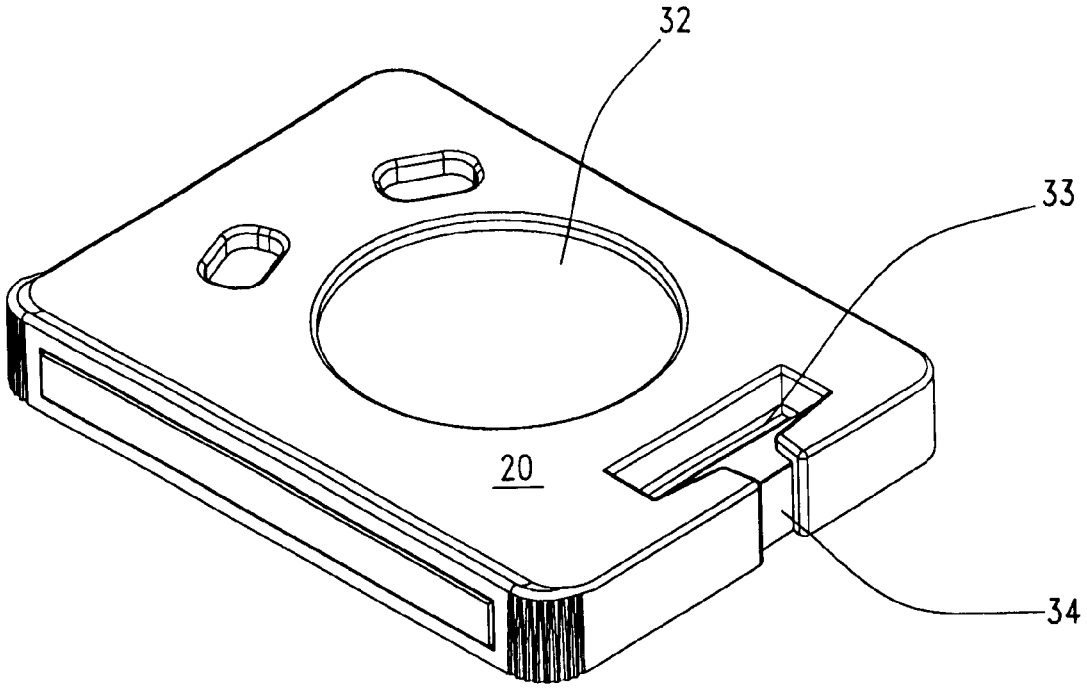
FIG. 6 is a perspective view of a modification of the invention shown in FIG. 3.

The structure of the modification of the holder shown in FIG. 6 is virtually identical to that shown in FIG. 3 with the addition of detent 32 for the purpose of receiving a glass or tumbler. Of course, any desired advertising indicia may be placed in the middle of base panel 20 or within detent 32. The holder shown in FIG. 6 also includes razor holder means in the form of elongated quadrilateral detent 33 formed in base panel 20 and indented groove 34 extending from detent 33 across base panel 20 and downwardly through sanitary band 21.

In operation, the holder shown in FIGS. 3–6 is typically packaged in clear plastic whereby the user simply removes it from the plastic and then peels back the conventional protective strip covering adhesive tape 28 thereby exposing the outer adhesive surface which allows the user to attach the holder to a bathroom mirror or other flat surface. Then toothbrushes can be inserted into apertures 22–25 and a razor can be positioned in detent 33 with the handle thereof extending through groove 34. Therefore, by this invention, a completely sanitary holder for toothbrushes, a razor and glass is provided which can be simply discarded after use.

What is claimed is:

1. A sanitary holder comprising a base panel, at least one aperture formed in said base panel, a first sanitary band integrally joined to the periphery of said base panel and extending downwardly therefrom a distance substantially below said base panel, the outer edge of said base panel extending upwardly and outwardly to form a ridge around the periphery of said base panel, a quadrilateral detent formed in said base panel, and a channel extending from said quadrilateral detent and being formed in said base panel and in said first sanitary band.

2. A sanitary holder according to claim 1 wherein said cover is flexible and disposable.

3. A sanitary holder according to claim 1 wherein a second sanitary band is attached to said base panel and extends around the periphery of said aperture.

4. A sanitary holder according to claim 1 wherein said base panel is of quadrilateral configuration and the corners of said first sanitary band are of a rippled configuration.

5. A sanitary holder according to claim 4 wherein a detent is formed in one linear portion of said first sanitary band and wherein adhesive tape is disposed in said detent.

6. A sanitary holder according to claim 1 wherein a circular detent is formed in said base panel.

7. A sanitary holder according to claim 1 wherein at least a portion of the periphery of said base panel is raised.

8. A sanitary holder according to claim 7 wherein said raised portion is defined by a ridge and slope combination.

* * * * *